US008374378B2

(12) United States Patent
Hopkinson et al.

(10) Patent No.: US 8,374,378 B2
(45) **Date of Patent: *Feb. 12, 2013**

(54) PORTABLE COMPUTER SPEAKER GRILL STRUCTURES

(75) Inventors: Ron Hopkinson, Campbell, CA (US); John Raff, Menlo Park, CA (US); Bartley K. Andre, Menlo Park, CA (US); Chris Ligtenberg, San Carlos, CA (US); Ruchi Goel, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/458,539

(22) Filed: Apr. 27, 2012

(65) Prior Publication Data

US 2012/0212903 A1 Aug. 23, 2012

Related U.S. Application Data

(63) Continuation of application No. 12/340,626, filed on Dec. 19, 2008, now Pat. No. 8,170,266.

(60) Provisional application No. 61/105,036, filed on Oct. 13, 2008.

(51) Int. Cl.
*H04R 1/02* (2006.01)

(52) U.S. Cl. .... 381/391; 381/386; 381/395; 361/679.01

(58) Field of Classification Search ..... 381/391, 381/386, 395; 361/679.01
See application file for complete search history.

(56) References Cited

U.S. PATENT DOCUMENTS

| | | | |
|---|---|---|---|
| 3,568,139 | A | 3/1971 | Delzer |
| 4,224,383 | A | 9/1980 | Taylor |
| 4,270,827 | A | 6/1981 | Potgieter |
| 4,473,264 | A | 9/1984 | Julian et al. |
| 4,920,018 | A | 4/1990 | Turner |
| 4,991,058 | A | 2/1991 | Watkins et al. |
| 5,155,662 | A | 10/1992 | I-Shou |
| 5,169,338 | A | 12/1992 | Dewar et al. |
| 5,187,643 | A | 2/1993 | I-Shou |
| 5,323,291 | A | 6/1994 | Boyle et al. |
| 5,325,984 | A | 7/1994 | Ady et al. |
| 5,346,407 | A | 9/1994 | Hood |
| 5,347,425 | A | 9/1994 | Herron et al. |
| 5,566,048 | A | 10/1996 | Esterberg et al. |
| 5,572,402 | A | 11/1996 | Jeong |
| 5,577,704 | A | 11/1996 | Pierce et al. |
| D380,456 | S | 7/1997 | Coster et al. |
| 5,670,267 | A | 9/1997 | Lee |
| 5,808,864 | A | 9/1998 | Jung |
| 5,870,485 | A | 2/1999 | Lundgren et al. |
| 5,895,440 | A | 4/1999 | Proctor et al. |

(Continued)

OTHER PUBLICATIONS

Wikipedia contributors, "MacBook Pro," Wikipedia, The Free Encyclopedia, [online] <http://en.wikipedia.org/w/index.php?title=MacBook_Pro&oldid=464376819>, retrieved Dec. 9, 2011.

(Continued)

*Primary Examiner* — Tu-Tu Ho
(74) *Attorney, Agent, or Firm* — Womble Carlyle Sandridge & Rice LLP

(57) ABSTRACT

Portable computer structures are provided. The portable computer structures may include speaker grill structures. A speaker grill structure may be formed by creating an array of small holes (perforations) in a portable computer housing structure such as a planar housing wall. A speaker may be mounted adjacent to the array of holes. The planar housing wall may be formed in a block of milled aluminum and may have a thickness of less than 1 mm. The speaker holes may have with small diameters without overly attenuating sound from a speaker.

20 Claims, 7 Drawing Sheets

U.S. PATENT DOCUMENTS

| | | | | |
|---|---|---|---|---|
| 5,910,991 | A | 6/1999 | Farrar | |
| 5,957,553 | A | 9/1999 | Shikata et al. | |
| RE36,381 | E | 11/1999 | Boyle et al. | |
| 6,068,520 | A | 5/2000 | Winings et al. | |
| 6,188,569 | B1 * | 2/2001 | Minemoto et al. | 361/679.33 |
| 6,249,426 | B1 | 6/2001 | O'Neal et al. | |
| 6,297,946 | B2 | 10/2001 | O'Neal et al. | |
| 6,304,060 | B1 | 10/2001 | Dernehl | |
| 6,304,433 | B2 | 10/2001 | O'Neal et al. | |
| 6,413,120 | B1 | 7/2002 | Winings | |
| 6,477,035 | B1 | 11/2002 | Cepas et al. | |
| 6,483,719 | B1 | 11/2002 | Bachman | |
| 6,501,644 | B1 | 12/2002 | Silverman et al. | |
| 6,660,427 | B1 | 12/2003 | Hukill et al. | |
| 6,751,484 | B1 | 6/2004 | Sandelius et al. | |
| 6,781,827 | B2 | 8/2004 | Goodman et al. | |
| 6,879,259 | B1 | 4/2005 | Smith et al. | |
| 6,887,616 | B2 | 5/2005 | Kim et al. | |
| 7,013,558 | B2 | 3/2006 | Bachman | |
| 7,075,785 | B2 | 7/2006 | Minaguchi et al. | |
| 7,230,825 | B2 | 6/2007 | Sawyer | |
| 7,236,154 | B1 | 6/2007 | Kerr et al. | |
| 7,612,997 | B1 | 11/2009 | Diebel et al. | |
| 7,911,780 | B2 | 3/2011 | Ali et al. | |
| 8,055,003 | B2 | 11/2011 | Mittleman et al. | |
| 8,170,266 | B2 * | 5/2012 | Hopkinson et al. | 381/391 |
| 2005/0023022 | A1 | 2/2005 | Kriege et al. | |
| 2006/0012969 | A1 | 1/2006 | Bachman | |
| 2006/0141344 | A1 | 6/2006 | Chen et al. | |
| 2006/0172183 | A1 | 8/2006 | Chen et al. | |
| 2007/0031727 | A1 | 2/2007 | Hsu | |
| 2007/0111086 | A1 | 5/2007 | Li et al. | |
| 2007/0117598 | A1 | 5/2007 | Yang et al. | |
| 2007/0151751 | A1 | 7/2007 | Robbins et al. | |
| 2008/0013268 | A1 | 1/2008 | Wong et al. | |
| 2008/0044053 | A1 | 2/2008 | Belanger et al. | |
| 2010/0091442 | A1 | 4/2010 | Theobald et al. | |

OTHER PUBLICATIONS iFixit contributors, "MacBook Pro 15" Unibody Teardown," iFixit, [online] <http://www.ifixit.com/Teardown/MacBook-Pro-15-Inch-Unibody-Teardown/590/1> and <http://guide-images.ifixit.net/igi/5MnXtxSUA21V2jVh.huge>, retrieved Dec. 9, 2011.

Rojas, Peter, "Hands-on with the MacBook Pro," Engadget, [online] <http://www.engadget.com/2006/01/10/hands-on-with-the-macbook-pro/>, Jan. 10, 2006, retrieved Dec. 9, 2011.

* cited by examiner

PORTABLE COMPUTER SPEAKER GRILL STRUCTURES

This application is a continuation of patent application Ser. No. 12/340,626, filed Dec. 19, 2008 now U.S. Pat. No. 8,170,266, which claims the benefit of provisional patent application No. 61/105,036, filed Oct. 13, 2008, both of which are hereby incorporated by reference herein in their entireties. This application claims the benefit of and claims priority to patent application Ser. No. 12/340,626, filed Dec. 19, 2008 and provisional patent application No. 61/105,036, filed Oct. 13, 2008.

BACKGROUND

This invention relates to electronic devices and, more particularly, to audio structures such as speaker grill structures for electronic devices such as portable computers.

Designers of portable computer speaker enclosures are faced with competing demands. Speaker grills should allow sound to be freely emitted from within a portable computer. At the same time, a speaker grill cannot be too porous. Speaker grills that have openings that are too large may fail to properly protect speakers from damage and may not be able to prevent the intrusion of foreign matter to the interior of the computer.

It would therefore be desirable to be able to provide improved audio structures such as speaker grill structures for electronic devices such as portable computers.

SUMMARY

Electronic devices such as portable computers with improved audio structures such as speaker grill structures are provided. An electronic device may have a case in which speaker grill structures are formed. Each speaker grill structure may be formed by creating an array of small holes (perforations) in the case of the device.

The size and spacing (pitch) of the holes created in the case to form a speaker grill structure may be selected such that the speaker grill structure passes sound waves with a minimal impact on the amplitude (e.g., sound pressure level) of the sound waves. For example, the size and spacing of the holes may be selected such that the speaker grill structure reduces the sound pressure of the sound waves by less than three decibels within an audio frequency range of interest.

Further features of the invention, its nature and various advantages will be more apparent from the accompanying drawings and the following detailed description of the preferred embodiments.

DETAILED DESCRIPTION

The present invention relates to audio structures for electronic devices. Speaker structures may be provided that protect a speaker that is mounted within the interior of an electronic device from damage while allowing sound to pass between the interior and exterior of the device.

The electronic device in which the speaker structures are formed may be a handheld computer, a miniature or wearable device, a portable computer, a desktop computer, a mobile telephone, a music player, a remote control, a global positioning system device, devices that combine the functions of one or more of these devices and other suitable devices, or any other electronic device. With one suitable arrangement, which is sometimes described herein as an example, the electronic devices in which the speaker structures are provided may be portable computers such as laptop (notebook) computers. This is, however, merely illustrative. Speaker structures may, in general, be provided in any suitable electronic device.

Figure 1:
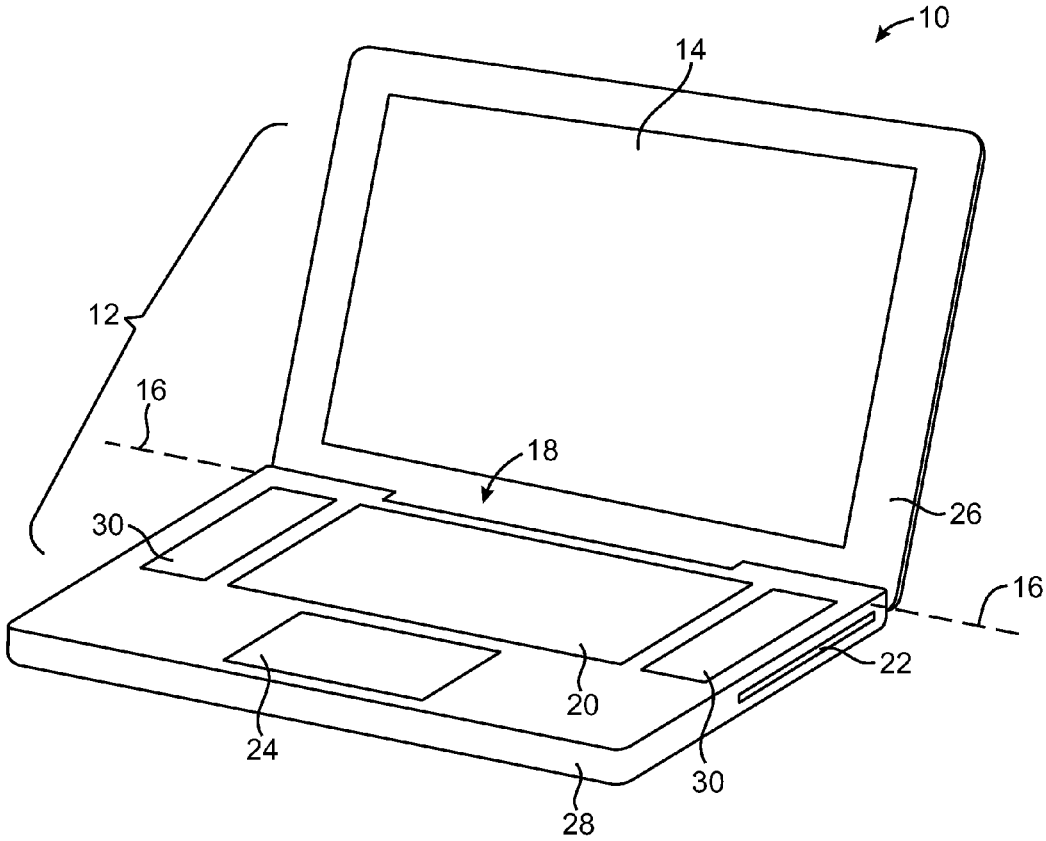
FIG. 1 is a perspective view of an illustrative electronic device such as a portable computer in accordance with an embodiment of the present invention.

An illustrative electronic device such as a portable computer in which speaker structures may be provided is shown in FIG. 1. As shown in FIG. 1, portable computer 10 may have a housing 12. Housing 12, which is sometimes referred to as a case, may be formed from one or more individual structures. For example, housing 12 may have a main structural support member that is formed from a solid block of machined aluminum or other suitable metal. One or more additional structures may be connected to the housing 12. These structures may include, for example, internal frame members, external coverings such as sheets of metal, etc. Housing 12 and its associated components may, in general, be formed from any suitable materials such as such as plastic, ceramics, metal, glass, etc. An advantage of forming housing 12 at least partly from metal is that metal is durable and attractive in appearance. Metals such as aluminum may be anodized to form an insulating oxide coating.

Housing 12 may have an upper portion 26 and a lower portion 28. Lower portion 28 may be referred to as the base or main unit of computer 10 and may contain components such as a hard disk drive, battery, and main logic board. Upper portion 26, which is sometimes referred to as a cover or lid, may rotate relative to lower portion 28 about rotational axis 16. Portion 18 of computer 10 may contain a hinge and associated clutch structures and is sometimes referred to as a clutch barrel.

Lower housing portion 28 may have a slot such as slot 22 through which optical disks may be loaded into an optical disk drive. Lower housing portion may also have a touchpad such as touchpad 24 and may have keys 20. If desired, additional components may be mounted to upper and lower housing portions 26 and 28. For example, upper and lower housing portions 26 and 28 may have ports to which cables can be connected (e.g., universal serial bus ports, an Ethernet port, a Firewire port, audio jacks, card slots, etc.). Buttons and other controls may also be mounted to housing 12.

If desired, upper and lower housing portions 26 and 28 may have transparent windows through which light may be emitted (e.g., from light-emitting diodes). This type of arrangement may be used, for example, to display status information to a user.

Openings may be formed in the surface of upper and lower housing portions to allow sound to pass through the walls of housing 12. For example, openings may be formed in housing walls for microphone and speaker ports (collectively "audio ports"). Speaker openings such as speaker openings (e.g., speaker grill structures 30) may be formed in lower housing portion 28 by creating an array of small openings (perforations) in the surface of housing 12.

A display such as display 14 may be mounted within upper housing portion 26. Display 14 may be, for example, a liquid crystal display (LCD), organic light emitting diode (OLED) display, or plasma display (as examples). A glass panel may be mounted in front of display 14. The glass panel may help add structural integrity to computer 10. For example, the glass panel may make upper housing portion 26 more rigid and may protect display 14 from damage due to contact with keys or other structures.

Computer 10 may have input-output components such as touch pad 24. Touch pad 24 may include a touch sensitive surface that allows a user of computer 10 to control computer 10 using touch-based commands (gestures). A portion of touchpad 24 may be depressed by the user when the user desires to "click" on a displayed item on screen 14.

Figure 2:
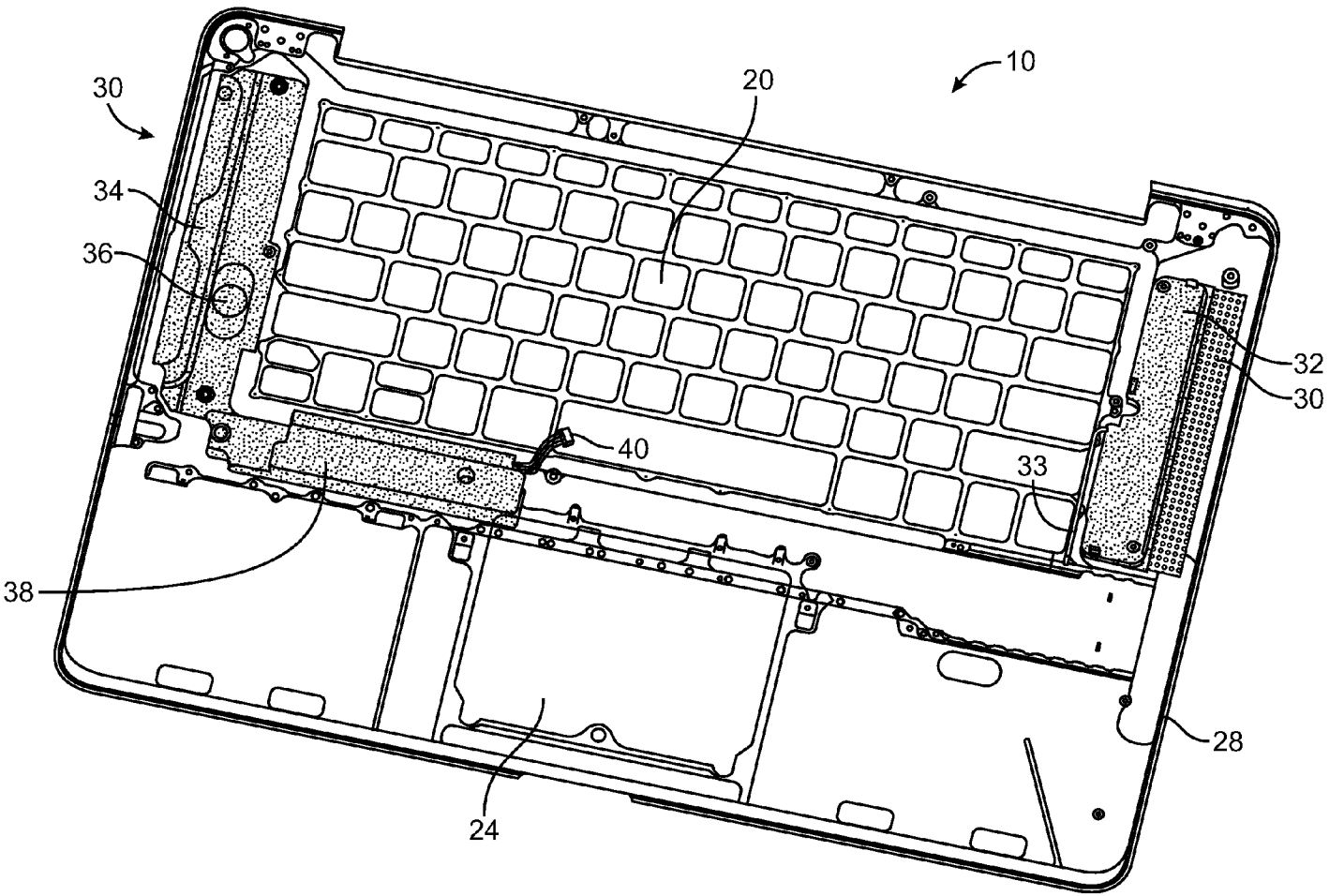
FIG. 2 is a perspective view of an interior portion of a housing for a portable computer showing illustrative speaker structures that may be used in the portable computer in accordance with an embodiment of the present invention.

A perspective view of an illustrative housing portion 28 having speaker structures that may be used in computer 10 is shown in FIG. 2. As shown in FIG. 2, speaker enclosures such as speaker enclosures 32, 34, and 38 may be mounted within lower housing portion 28. With one suitable arrangement, speaker enclosures 32 and 34 may be mounted beneath speaker openings 30 (e.g., speaker grill structures 30 for speaker ports).

Speaker enclosures in device 10 such as speaker enclosures 32, 34, and 38 may contain one or more speaker drivers (e.g., speakers). For example, driver 36 may be mounted in enclosure 34. Drivers such as driver 36 may be mounted in speaker enclosures using any suitable method such as screws, adhesive, etc. If desired, one or more speaker enclosures in device 10 may be configured to produce sound at particular frequencies. As an example, a speaker enclosure may contain one or more speakers configured to produce sound at relatively low frequencies. With one suitable arrangement, one or more speakers such as woofers and mid-range drivers (collectively "bass speakers") may be mounted in speaker enclosure 38.

As illustrated by FIG. 2, speaker enclosure 38 may not be mounted beneath a speaker opening in the housing of device 10. In this type of arrangement, speaker enclosure 38 can be connected to speaker enclosure 34 (e.g., through an interior passage between the two respective enclosures or using other suitable coupling structures). When the speaker enclosures are connected in this way, sound that is generated by a driver in enclosure 38 travels through enclosures 38 and 34 and exits device 10 through opening 30.

Paths such as electrical paths 33 and 40 may be used to electrically connected speaker drivers in speaker enclosures 32, 34, and 38 to circuitry in device 10. For example, paths 33 and 40 may connect to audio amplifier circuitry in device 10 to transmit amplified power signals between the audio amplifier circuitry and speaker drivers such as driver 36.

Figure 3:
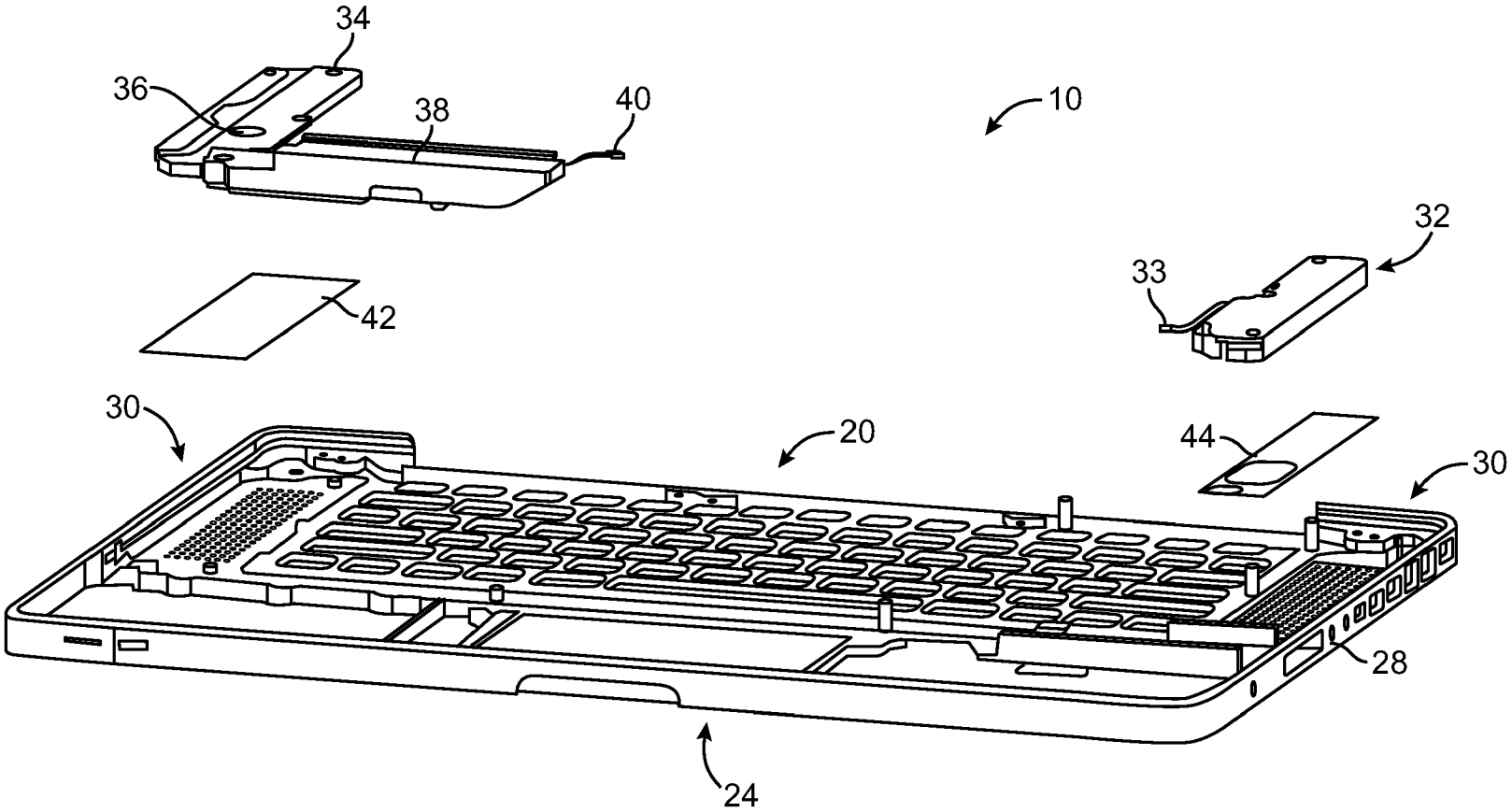
FIG. 3 is an exploded perspective view of the illustrative speaker and housing structures for a portable computer in accordance with an embodiment of the present invention.

FIG. 3 shows an exploded perspective view of speaker enclosures 32, 36, and 38 of FIG. 2. As shown in FIG. 3, device 10 may have mesh structures between openings 30 and enclosures 32, 34, and 38. For example, mesh 42 may be interposed between enclosure 34 and its associated opening 30 and mesh 44 may be interposed between enclosure 32 and its associated speaker opening 30.

Mesh 42 and mesh 44 may be, for example, speaker meshes that are mounted to lower housing portion 28 with adhesive. Speaker mesh, which may sometimes be referred to as acoustic mesh, may be formed from plastic, metal, or other suitable materials. With one suitable arrangement, speaker meshes 42 and 44 may serve to improve the exterior aesthetic appearance of device 10 without impeding the passage of sound waves from speaker enclosures and drivers to the exterior of device 10 through openings 30. Speaker meshes 42 may improve the aesthetic appearance of device 10 by preventing a user of device 10 from being able to see through openings 30 to speaker enclosures 32, 34, and 38 and/or speaker drivers such as driver 36.

Figure 4:
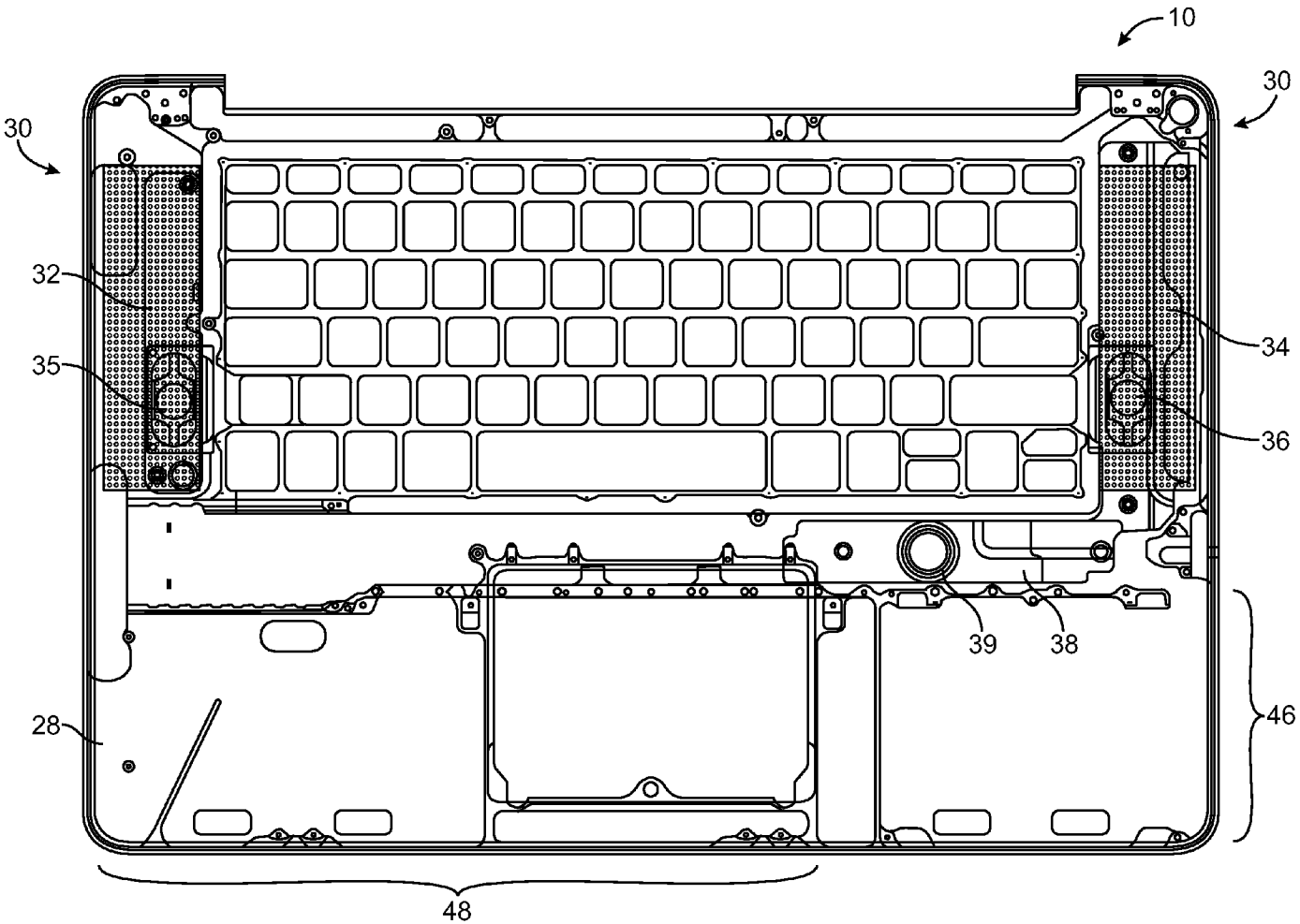
FIG. 4 shows the interior of a portable computer housing structure having illustrative speaker grill structures that may be formed on the surface of the housing structure and associated speaker drivers that may generate sound that passes through the speaker grill structures in accordance with an embodiment of the present invention.

FIG. 4 illustrates how speaker grill structures 30 can allow sound from speaker enclosures 32, 34, and 38 to escape from within device 10 (e.g., from within lower housing portion 28). Each of the speaker enclosures may have one or more speaker drivers. For example, driver 35 may be mounted within enclosure 32, driver 36 may be mounted within enclosure 34, and driver 39 may be mounted within enclosure 38.

As shown in FIG. 4, speaker enclosure 38 may contain a driver such as driver 39 that is not directly beneath a speaker grill structures such as one of structures 30 in device 10. With one suitable arrangement, sound waves produced by driver 39 may be transmitted from within enclosure 38 to enclosure 34 (e.g., sound waves may be transmitted from enclosure 38 to enclosure 34 because the enclosures are firmly connected together) and then out of enclosure 34 through the speaker grill structure associated with enclosure 34.

Other components of device 10 may also be mounted within lower housing portion 28. For example, a battery may be mounted in region 48 of lower housing portion 28 and a hard disk drive may be mounted within region 46 of lower housing portion 28.

With one suitable arrangement, each speaker grill structure 30 may be formed from an array of small openings (perforations) in lower housing portion 28 of device 10. Any suitable number of perforations in housing portion 28 may be used to form each speaker grill 30. For example, each grill 30 may be formed from 100 holes or more, 500 holes or more, 1000 holes or more, 5000 holes or more, 7500 holes or more, 10000 holes or more, more than ten thousand holes, etc.

While speaker grills 30 are described herein as an array and are illustrated as a relatively large number of holes which are vertically and horizontally aligned, holes in housing portion 28 which form speaker grills 30 do not, in general, need to be formed in an array and can be formed using any suitable pattern. If desired, the holes that are made in housing portion 28 to form speaker grills 30 may be formed in an off-set array pattern in which each row of holes is slightly offset from the vertically adjacent rows of holes. With another suitable arrangement, holes that are made in housing portion 28 to form speaker grills 30 may be formed randomly or in other patterns.

Figure 5:
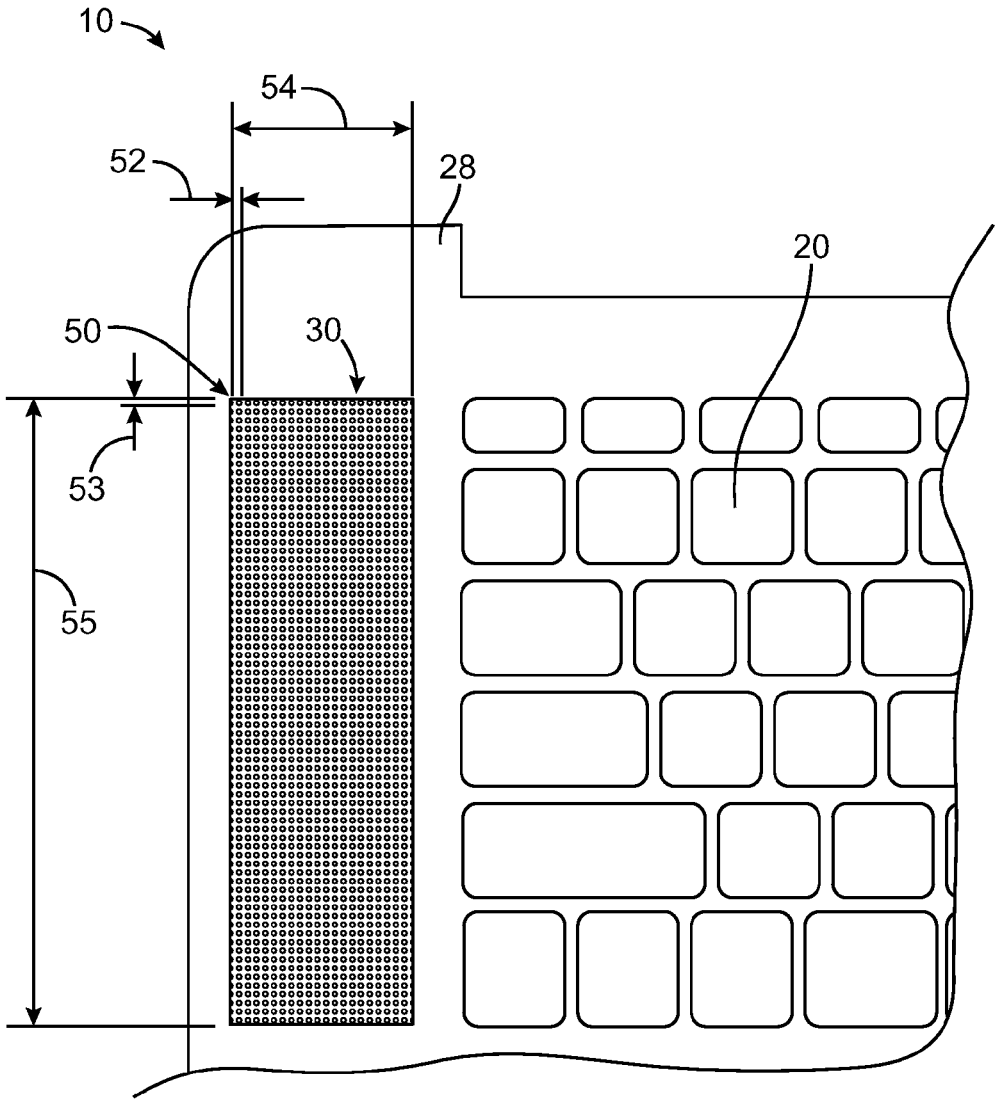
FIG. 5 is a top view of a portion of an illustrative portable computer case in which a speaker grill structure has been formed from an array of small holes in accordance with an embodiment of the present invention.

As shown in FIG. 5, with one suitable arrangement, the holes that form speaker grills 30 may be relatively uniform in size, shape, and location relative to each other. Each hole may have any suitable diameter 50, may be spaced at any suitable horizontal distance 52 from other holes, and may be spaced at any suitable vertical distance 53 from other holes that form grills 30. For example, each hole may have a diameter such as diameter 50 of approximately 0.35 millimeters (i.e., more than 0.3 mm and less than 0.4 mm) and the centers of each holes may be 0.917 millimeters (e.g., 0.8 mm to 1.0 mm) apart in the horizontal direction (e.g., as illustrated by horizontal pitch 52) and may be 0.913 millimeters (e.g., 0.8 mm to 1.0 mm) apart in the vertical direction (e.g., as illustrated by vertical pitch 53. The array of holes that form each speaker grill structure 30 may also have any suitable width 54 and length 55. For example, each speaker grill structure 30 may be formed from an array of perforations in lower housing portion 28 that span a vertical distance of 103.125 millimeters (e.g., 80 mm to 120 mm) and that span a horizontal distance of 29.348 millimeters (e.g., 20 mm to 40 mm) as illustrated by array length 55 and array width 54.

If desired, the size and the pitch of holes that form speaker grill structures 30 may be configured to optimize the performance of the speaker grills. For example, the size (diameter) of each of the speaker grill holes and the horizontal and vertical separation between each hole (e.g., the pitch of the holes) may be selected using a graph such as the graph of FIG. 6.

Figure 6:
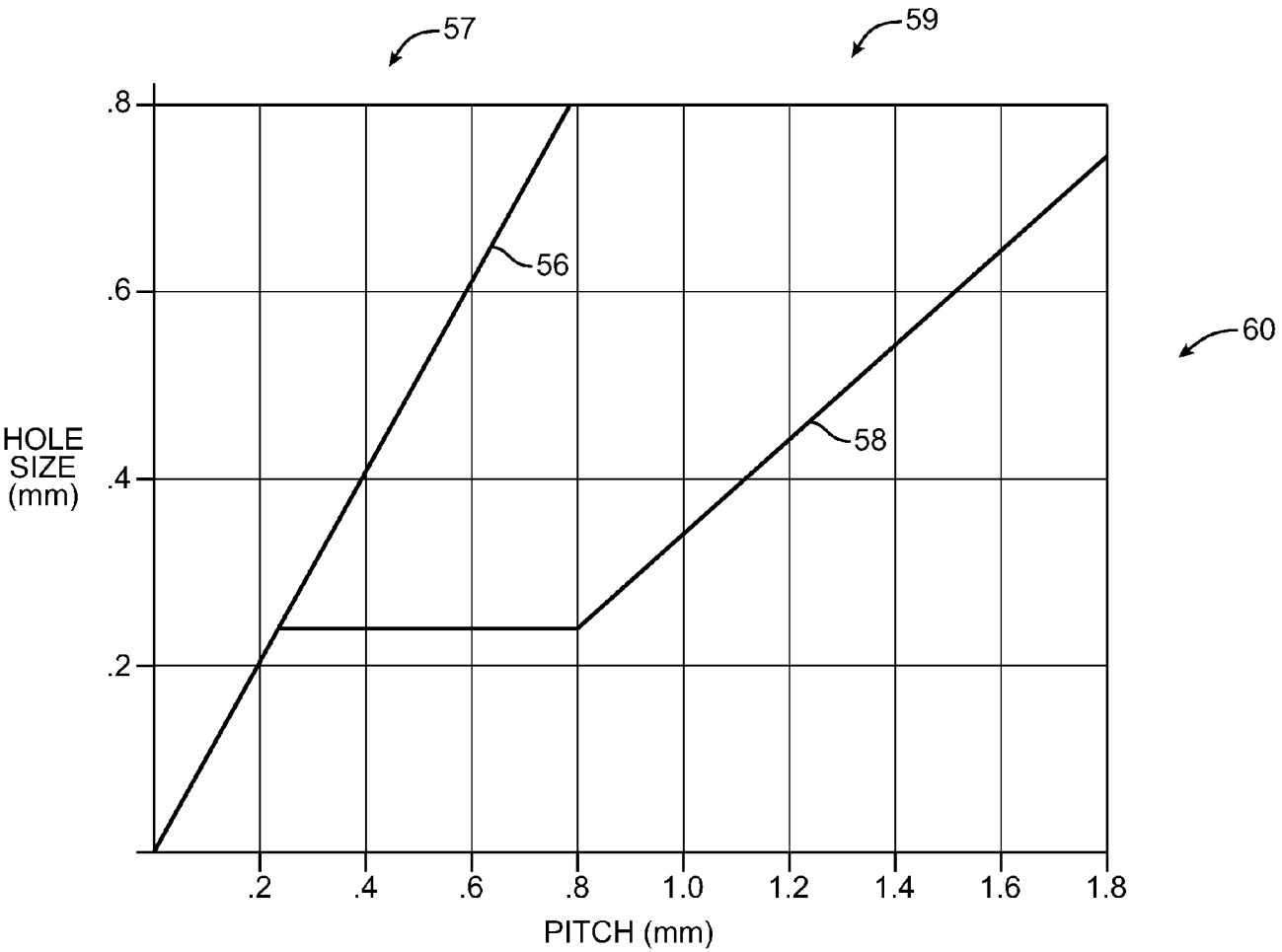
FIG. 6 is a graph of audio pass-through characteristics for illustrative speaker grills as a function of pitch and hole size in accordance with an embodiment of the present invention.

Line 56 in the graph of FIG. 6 may separate region 57 from region 59 of the FIG. 6 graph. Region 57 of the FIG. 6 graph represents a physically impossible configuration in which the diameter of the holes is larger than the separation between the centers of each of the holes. If speaker grill structures were formed from holes with sizes and pitches in region 57, the speaker grill structures would essentially be a single opening and not a collection of holes.

When a speaker grill structure such as grill 30 is formed from holes with properties that lie in region 59, the speaker grill structure may have suitable audio properties for use in an electronic device such as a portable computer. In particular, a speaker grill having the properties of region 59 may allow sound to pass through with a loss of sound pressure (volume) of no more than three decibels (dBs) in a desired frequency range (e.g., from about 20 Hz, 50 Hz, 100 Hz, 200 Hz, 500 Hz or other suitable low-frequency value to up to about 10 kHz, 15 kHz, 20 kHz, or other suitable high-frequency value).

Frequencies within audio ranges such as these (e.g., between 500 Hz and 10 kHz) fall within the normal range of human hearing and can be reproduced by portable computer speakers. Frequencies outside of these normal human audio ranges need not generally be reproduced and are of less interest. For example, the upper range of adult human hearing tends to decrease with age, so frequencies above 10 kHz (and even more so above 20 kHz) are not generally necessary in a portable device. Very low frequencies (e.g., 20 Hz and below) can be difficult or impossible to reproduce in a small speaker, so computer users are not expecting sound reproduction in this frequency range. Because of these considerations, a typical frequency range of interest for a computer speaker may be about 500 Hz to 10 kHz (as an example). Suitable configurations for grill 30 will not overly attenuate sound within this type of normal human hearing frequency range. For example, grill 30 may be configured to introduce no more than about 3 dB (50%) of sound level attenuation at any given frequency within a range of 500 Hz to 10 kHz range (or other suitable range) by following the holes size and spacing limits imposed by region 59. If a different desired attenuation limit is changed (e.g., to 2 dB or 4 dB) and/or if the frequency range of interest is changed (e.g., to have an upper limit of 15 kHz), the hole size and spacing limits of FIG. 6 may be adjusted, accordingly.

Line 58 may separate region 59 from region 60 of the FIG. 6 graph. Speaker grill structures formed from holes with properties that lie in region 59 will tend to pass sound with a loss of less than three dBs of sound pressure (e.g., within a range of 500 Hz to 10 kHz range or other suitable audio range associated with normal human hearing). Speaker grill structures formed from holes with properties that lie in region 60 will tend to exhibit more than three dBs of sound pressure loss for at least some of these frequencies.

In order to ensure that speaker grill structures 30 perform satisfactorily, the graph of FIG. 6 may be used to determine an acceptable diameter and a pitch for holes that are used to form the speaker grill structure. As an example, the graph of FIG. 6 may be used to determine what combination of hole size and pitch (e.g., separation between holes) can be used to form a speaker grill structure which performs to a given standard (e.g., a speaker grill structure which passes sound with a loss of less than a given amount such as 1 dB, 2 dB, 3 dB, 4 dB, etc). An acceptable hole size may be, for example, greater than about 0.25 mm. An acceptable pitch may be greater than about 0.25 mm (for the smallest hole sizes). Larger holes (e.g., with diameters greater than 1 mm) may be acceptable for handling audio, but may have undesirable aesthetics. It may therefore be desirable if the hole size is about 0.25 mm to 0.5 mm and the pitch is about 0.25 mm to 1 mm (as an example).

Figure 7:
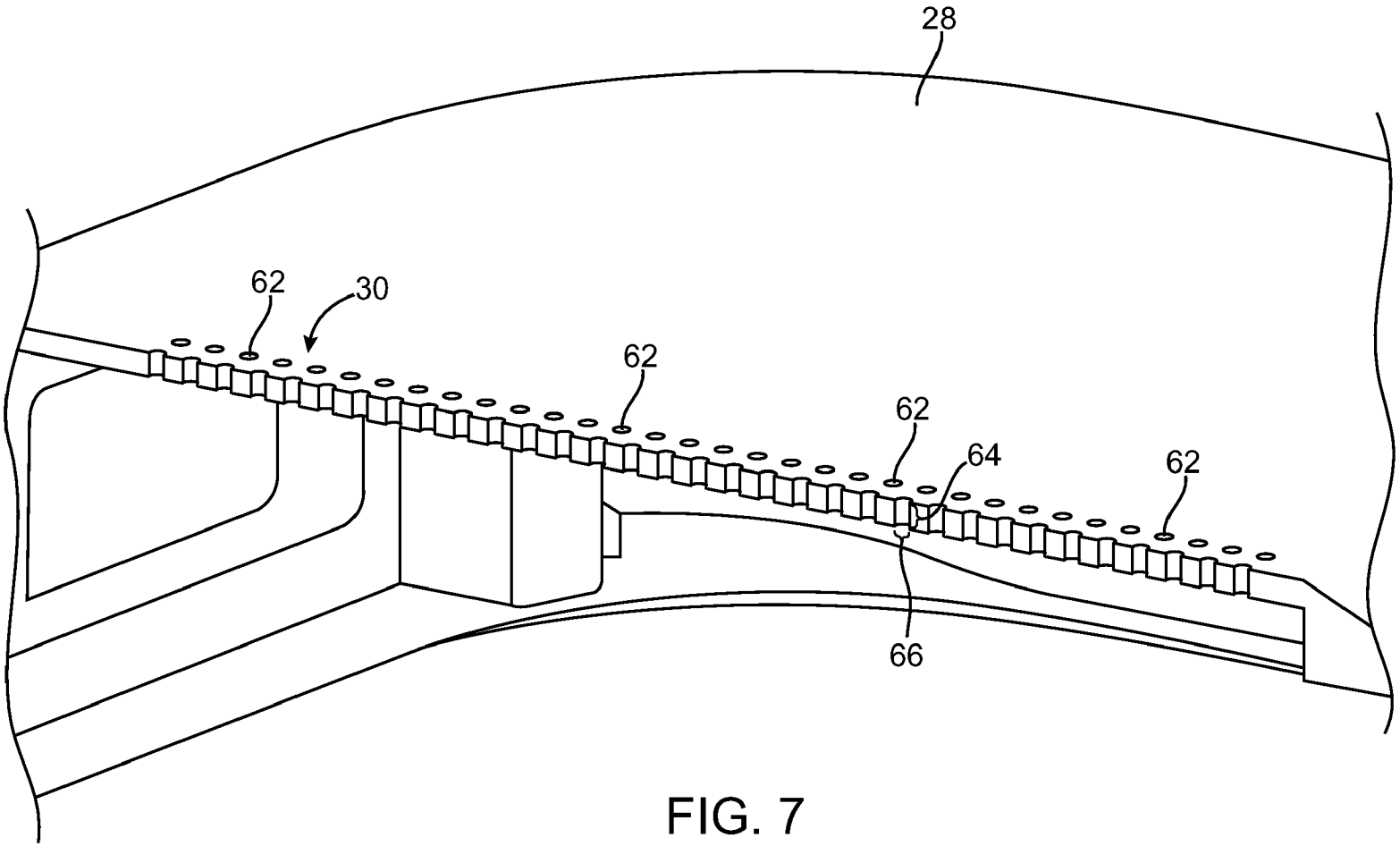
FIG. 7 is a cross-sectional perspective view of an illustrative speaker grill structure that may be formed in a portable computer housing that has been milled from a solid block of metal in accordance with an embodiment of the present invention.

FIG. 7 shows that holes 62 which are made in lower housing portion 28 to form speaker grill structures 30 may have an aspect ratio defined by the depth of the holes (e.g., depth 64) divided by the width of the holes (e.g., diameter 66). In general, holes 62 of structures 30 may have an aspect ratio of any suitable magnitude such as one-half to one, one to one (e.g., an equal depth and width), two to one, three to one, etc.

Lower housing portion 28 of device 10 may be milled from a solid block of metal. For example, housing portion 28 may be formed from a solid block of aluminum that is milled by a computer-controlled milling machine (e.g., a CNC). By milling housing portion 28 from a solid block of metal, the thickness of housing portion 28 in the regions corresponding to speaker grill structures 30 may be adjusted relative to the nominal thickness and dimension of the structures and planar surfaces in housing portion 28, if desired. With one suitable arrangement, the thickness of housing 28 in the regions corresponding to structures 30 may be 0.75 millimeters or less (e.g., less than 1 mm). When the thickness of speaker grill structures 30 is reduced, the aspect ratio of the holes that make up structures 30 will be decreased. This prevents sound from being blocked by holes with excessive aspect ratios. In addition, when the depth of holes 62 in structures 30 is reduced, it may take less time to form holes 62 in structures 30. In contrast, while deeper holes 62 may require additional time to form in structures 30, deeper holes 62 will generally provide structures 30 with increased structural integrity. By selecting an appropriate thickness for the regions of housing 28 corresponding to speaker grill structures 30, the time required for form holes 62 may be optimized without compromising the structural integrity of structures 30.

Holes 62 may be formed using any suitable method. With one arrangement, holes 62 are formed using laser drilling to remove portions of housing 28 corresponding to holes 62. For example, one or more laser beams may be used to drill holes 62 in housing 28. Beams of laser light may be shined at the locations of holes 62 in housing 28 and, if desired, the beams may be steered using mirrors or other suitable methods and/or by translating the lasers and/or workpiece to form all of the holes in each speaker grill structure 30. Holes 62 may also be formed using a gang drilling method (e.g., using multiple mechanical drills), stamping, or other suitable method.

The foregoing is merely illustrative of the principles of this invention and various modifications can be made by those skilled in the art without departing from the scope and spirit of the invention.

What is claimed is:

1. A portable computer, comprising:

a metal housing wall having a speaker grill region in which an array of speaker holes is formed, wherein the metal housing wall has a thickness, in the speaker grill region, of less than 1 mm and wherein each speaker hole has a diameter between approximately 0.25 mm and 0.5 mm; and a speaker driver adjacent to the array of speaker holes.

2. The portable computer defined in claim 1 wherein the metal housing wall includes at least a given region that is adjacent to the speaker grill region and wherein the thickness of the metal housing wall in the given region is greater than the thickness of metal housing wall in the speaker grill region.

3. The portable computer defined in claim 1 wherein each of the speaker holes has an aspect ratio defined by the thickness of the metal housing wall in the speaker grill region divided by the diameter of that speaker hole and wherein the aspect ratio of each of the speaker holes is approximately three to one.

4. The portable computer defined in claim 1 wherein each of the speaker holes has an aspect ratio defined by the thickness of the metal housing wall in the speaker grill region divided by the diameter of that speaker hole and wherein the aspect ratio of each of the speaker holes is approximately two to one.

5. The portable computer defined in claim 1 wherein the thickness of the metal housing wall in the speaker grill region is less than or equal to 0.75 mm.

6. The portable computer defined in claim 1 wherein the speaker holes are spaced apart from each other with a pitch of about 0.25 mm to 0.5 mm.

7. The portable computer defined in claim 1 further comprising:

keys in the metal housing wall, wherein the keys form a keyboard for the portable computer and wherein some of the keys are adjacent to the array of speaker holes.

8. The portable computer defined in claim 1 wherein the speaker grill region comprises a first speaker grill region in which a first array of speaker holes is formed, wherein the metal housing wall comprises a second speaker grill region in which a second array of speaker holes is formed.

9. The portable computer defined in claim 8 wherein each speaker hole in the second array of speaker holes has a diameter between approximately 0.25 mm and 0.5 mm and wherein the second speaker grill region has a thickness of less than 1 mm.

10. The portable computer defined in claim 1 further comprising:

a speaker enclosure in which the speaker driver is mounted; and a layer of mesh between the array of speaker holes and the speaker enclosure.

11. The portable computer defined in claim 1 further comprising:

at least one bass speaker, wherein the bass speaker is mounted within the portable computer so that the bass speaker is not under any speaker holes in the metal housing wall.

12. The portable computer defined in claim 1 further comprising:

a first speaker enclosure in which the speaker driver is mounted; and a bass speaker mounted in a second speaker enclosure, wherein the bass speaker is mounted within the portable computer so that the bass speaker is not under any speaker holes in the metal housing wall and wherein the first and second speaker enclosures are connected so that sound passes from the second speaker enclosure to the first speaker enclosure.

13. A portable computer, comprising:

a metal housing wall having a speaker grill region in which an array of speaker holes is formed, wherein the speaker holes are spaced apart from each other with a pitch of approximately 0.25 mm to 0.5 mm; and a speaker driver adjacent to the array of speaker holes.

14. The portable computer defined in claim 13 wherein the metal housing wall has a thickness, in the speaker grill region, of less than 1 mm.

15. The portable computer defined in claim 13 wherein the metal housing wall has a thickness, in the speaker grill region, of less than 1 mm such that the metal housing wall attenuates sound, within a range of 500 Hz to 10 kHz, from the speaker driver that passes through the metal housing wall by no more than approximately 3 dB.

16. The portable computer defined in claim 13 wherein the array of speaker holes comprises an array of at least 5000 speaker holes.

17. A portable computer, comprising:

a milled aluminum block including a planar metal housing wall with an array of speaker holes, each speaker hole having a diameter between approximately 0.25 mm and 0.5 mm; and a speaker driver adjacent to the array of speaker holes.

18. The portable computer defined in claim 17, wherein the planar metal housing wall has a thickness of less than 1 mm.

19. The portable computer defined in claim 18 further comprising a layer of mesh adjacent to the array of speaker holes, wherein the speaker holes comprise laser-drilled holes in the milled aluminum block.

20. The portable computer defined in claim 19 wherein the speaker holes are spaced apart from each other with a pitch of about 0.25 mm to 0.5 mm.

* * * * *